US007093521B2

(12) United States Patent
Lee

(10) Patent No.: US 7,093,521 B2
(45) Date of Patent: Aug. 22, 2006

(54) TELESCOPIC STRUCTURE FOR A TOOL

(76) Inventor: Chang Jauan Lee, No. 429-6, Jhong Jheng Rd., Caotun Township, Nantou County (TW)

( * ) Notice: Subject to any disclaimer, the term of this patent is extended or adjusted under 35 U.S.C. 154(b) by 0 days.

(21) Appl. No.: 10/879,926

(22) Filed: Jun. 28, 2004

(65) Prior Publication Data

US 2005/0284266 A1 Dec. 29, 2005

(51) Int. Cl.
*B25B 23/16* (2006.01)

(52) U.S. Cl. ..... 81/177.2; 81/63.1

(58) Field of Classification Search ..... 81/177.2, 81/60, 63.1, 177.1; 403/107–109; 16/115
See application file for complete search history.

(56) References Cited

U.S. PATENT DOCUMENTS 2,382,291 A * 8/1945 Carlberg ..... 403/107
4,581,958 A * 4/1986 Shull ..... 81/177.2
4,586,406 A * 5/1986 Howard ..... 81/177.2
6,431,031 B1 * 8/2002 Hu ..... 81/63.2
2004/0020331 A1 * 2/2004 Lee ..... 81/177.2
2005/0145074 A1 * 7/2005 Mau ..... 81/63
2005/0204873 A1 * 9/2005 Ana ..... 81/177.2
2005/0284266 A1 * 12/2005 Lee ..... 81/177.2

* cited by examiner

*Primary Examiner*—Lee D. Wilson
(74) *Attorney, Agent, or Firm*—Rosenberg, Klein & Lee

(57) ABSTRACT

A telescopic structure for a tool, wherein the tool includes a rod assembly and a handle, a first end of the rod assembly formed with a drive end, a second end of which is formed with a connecting end serving to be connected with the handle, the telescopic structure comprises an annular positioning groove formed on outer periphery of the rod assembly; an elastic ring elastically engaged in the annular positioning groove of the rod assembly in such a manner that the elastic ring expansively abuts against inner wall of the handle; a locking groove formed on the inner wall of the handle mutually engaged with the elastic ring.

5 Claims, 9 Drawing Sheets

TELESCOPIC STRUCTURE FOR A TOOL

BACKGROUND OF THE INVENTION

1. Field of the Invention

This invention relates to a telescopic structure for a tool, and more particularly to a telescopic structure capable of changing the entire length of the tool and saving the turning force applied on the handle for locking/unlocking a work piece during turning operation.

2. Description of the Prior Arts

Tools are widely applicable and generally used for assembling/disassembling/repairing/checking or adjusting operations, and more and more people like DIY, so the demand for the tools is very great. However, how to develop a tool capable of saving turning force during turning operation has become the motivation of the present invention.

Here takes torsion wrench as an example, as shown in FIG. 1, a conventional torsion wrench includes at least a rod 11, a central push rod 12, a work head 13 and a handle 14. The central push rod 12 is received in the rod 11. The work head 13 is mounted at an end of the rod 11 and connected with the central push rod 12. The handle 14 is adjustably mounted at another end of the rod 11 in such a manner that a drive portion 141 of the handle 14 is meshed with a threaded portion 121 of the central push rod 12. By such arrangements, the handle 14 can be adjusted to move the central push rod 12, and to set a torsion value as desired for turning a work piece with accurate torsion force. However, in real operation, this conventional torsion wrench still has some disadvantages as follows:

The handle 14 is adjustably mounted at the end of the rod 11 for adjusting purpose. However, it is unable to substantially increase the length of the torsion wrench. The handle 14 is to be held and adjusted by the user, and the work head 13 of the torsion wrench is connected to a work piece that requires precise torsion force. During the turning operation of the torsion wrench for locking/unlocking a work piece, the turning force is impossible saved due to the distance between the handle and the work piece to be operated is unchangeable. Thus, the turning operation it pretty hard when turning a work piece that requires great torsion force.

The present invention has arisen to mitigate and/or obviate the afore-described disadvantages.

SUMMARY OF THE INVENTION

The primary object of the present invention is to provide a telescopic structure for a tool, which is capable of saving turning force when locking/unlocking a work piece.

A telescopic structure for a tool in accordance with the present invention, in which, the tool includes a rod assembly and a handle, a first end of the rod assembly formed with a drive end for turning an object to be operated, a second end of the rod assembly formed with a connecting end which to be connected with the handle, the telescopic structure comprises an annular positioning groove formed on outer periphery of the rod assembly;

an elastic ring elastically engaged in the annular positioning groove of the rod assembly in such a manner that the elastic ring expansively abuts against inner wall of the handle;

a locking groove formed on the inner wall of the handle mutually engaged with the elastic ring;

wherein the elastic ring is compressed by the inner wall of the handle, pulling the handle in a direction away from the drive end till the locking groove of the handle is aligned to the elastic ring, the elastic ring will be expansively engaged in the locking groove, so that length of the tool is allowed to be adjusted, and turning force applied on a handle of a tool for locking/unlocking a work piece can be saved.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
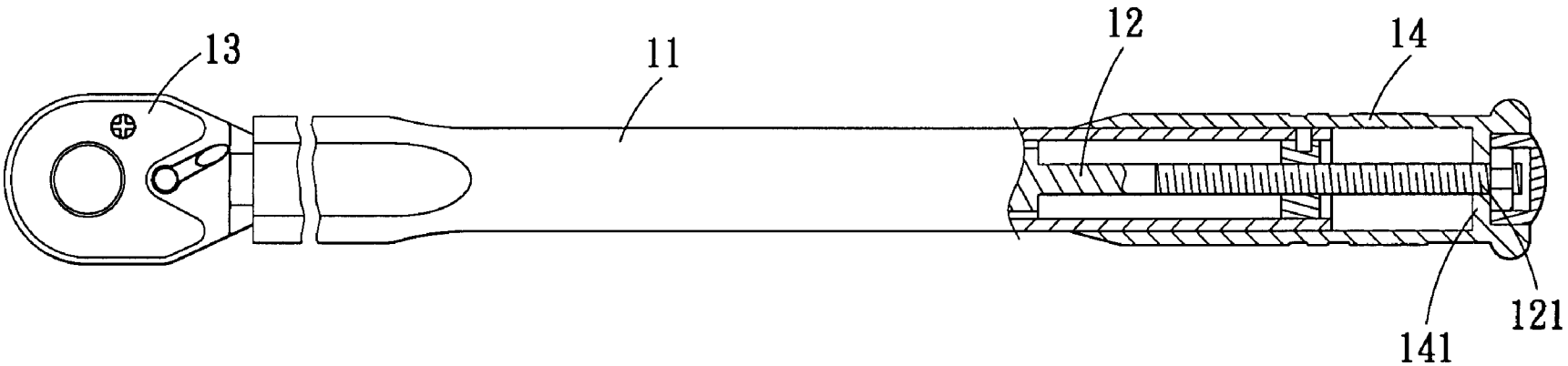
FIG. 1 PRIOR ART
FIG. 1 is a partial cross sectional view of a conventional torsion spanner.
Figure 2:
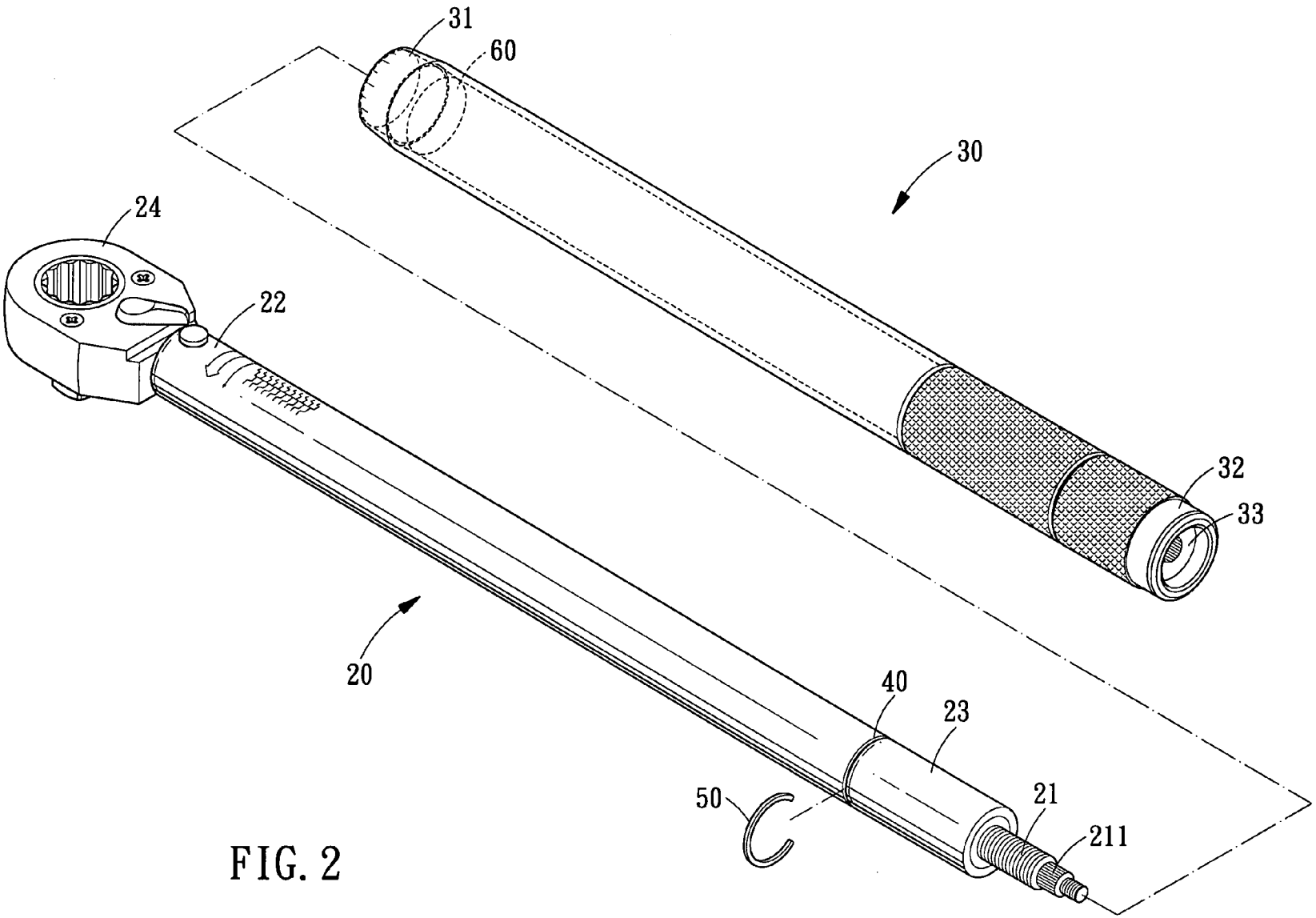
FIG. 2 is an exploded view of a telescopic structure for a tool in accordance with a first embodiment of the present invention.
Figure 3:
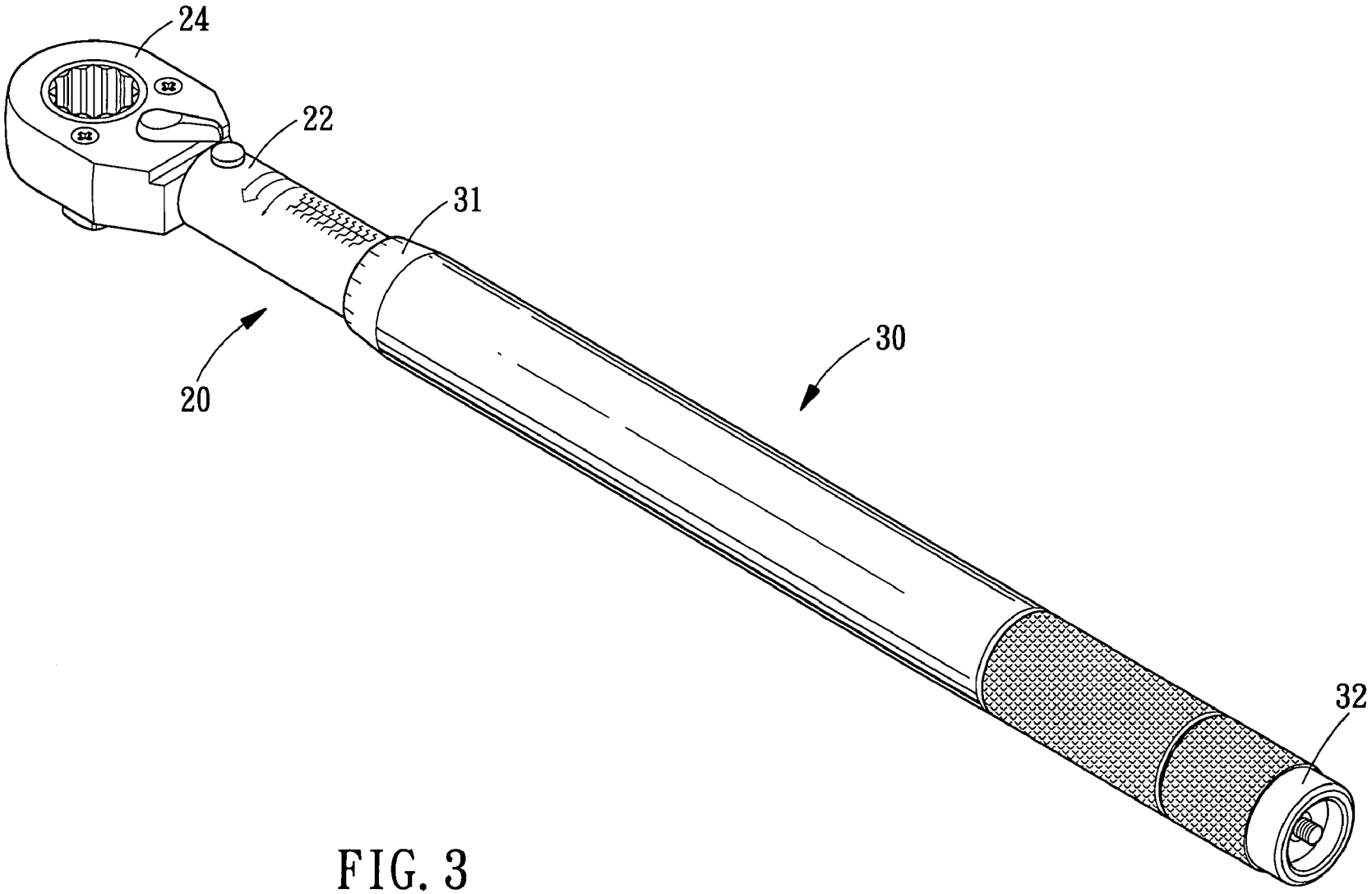
FIG. 3 is an assembly view of a telescopic structure for a tool in accordance with a first embodiment of the present invention.
Figure 4:
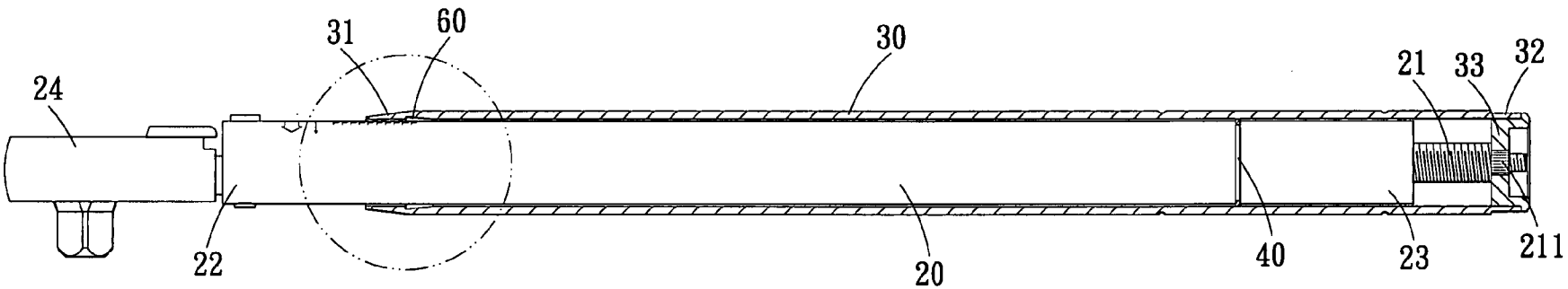
FIG. 4 is a cross sectional view of a telescopic structure for a tool in accordance with a first embodiment of the present invention.
Figure 5:
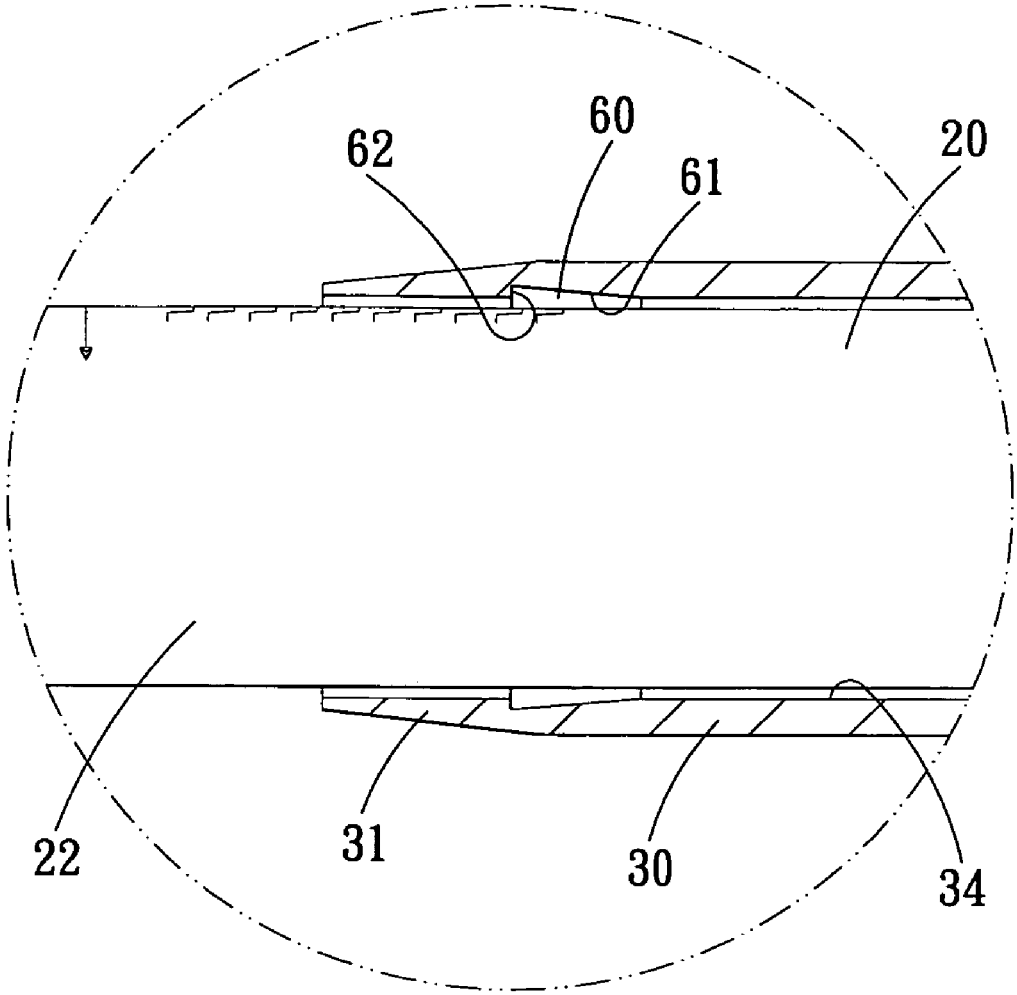
FIG. 5 is a partial amplified view of FIG. 4.

Referring to FIGS. 2–5, a telescopic structure for a tool in accordance with a first embodiment of the present invention is shown (here the tool is a torsion wrench for example) and the torsion wrench generally includes a rod assembly 20 and a handle 30. The rod assembly 20 is interiorly received a central push rod 21. A first end of the rod assembly 20 is a drive end 22, and a second end of which is a connecting end 23. On outer periphery of the rod assembly 20 is provided with torsion scale that is located close to the drive end 22. The drive end 22 is provided with a work head 24 that is connected with the central push rod 21. The handle 30 is a hollow pipe, the length of which in this embodiment is same as that of the rod assembly 20. A front end 31 of the handle 30 is formed on the outer periphery thereof with scale corresponding to the torsion scale on the rod assembly 20. A rear end 32 of the handle 30 is provided with a drive portion 33 which corresponds to threaded portion 211 on the central push rod 21. The telescopic structure includes an annular positioning groove 40, an elastic ring 50 and a locking groove 60.

The annular positioning groove 40 is formed on the outer periphery of the rod assembly 20 and located close to the connecting end 23.

The elastic ring 50, such as C-shaped retainer, has a rectangular cross section. The elastic ring 50 is elastically engaged in the positioning groove 40 of the rod assembly 20 in such a manner that the elastic ring 50 expansively abuts against the inner wall 34 of the handle 30.

The locking groove 60 is formed on the inner wall 34 of the handle 30 and located adjacent to the front end 31. The locking groove 60 includes an annular bevel surface 61 and an annular vertical surface 62. The annular bevel surface 61 is evenly and smoothly tilted toward the front end 31. The annular vertical surface 62 is vertical to the inner wall 34 of the handle 30 and connected with the annular bevel surface 61. The locking groove 60 is mutually engaged with the elastic ring 50.

Figure 6:
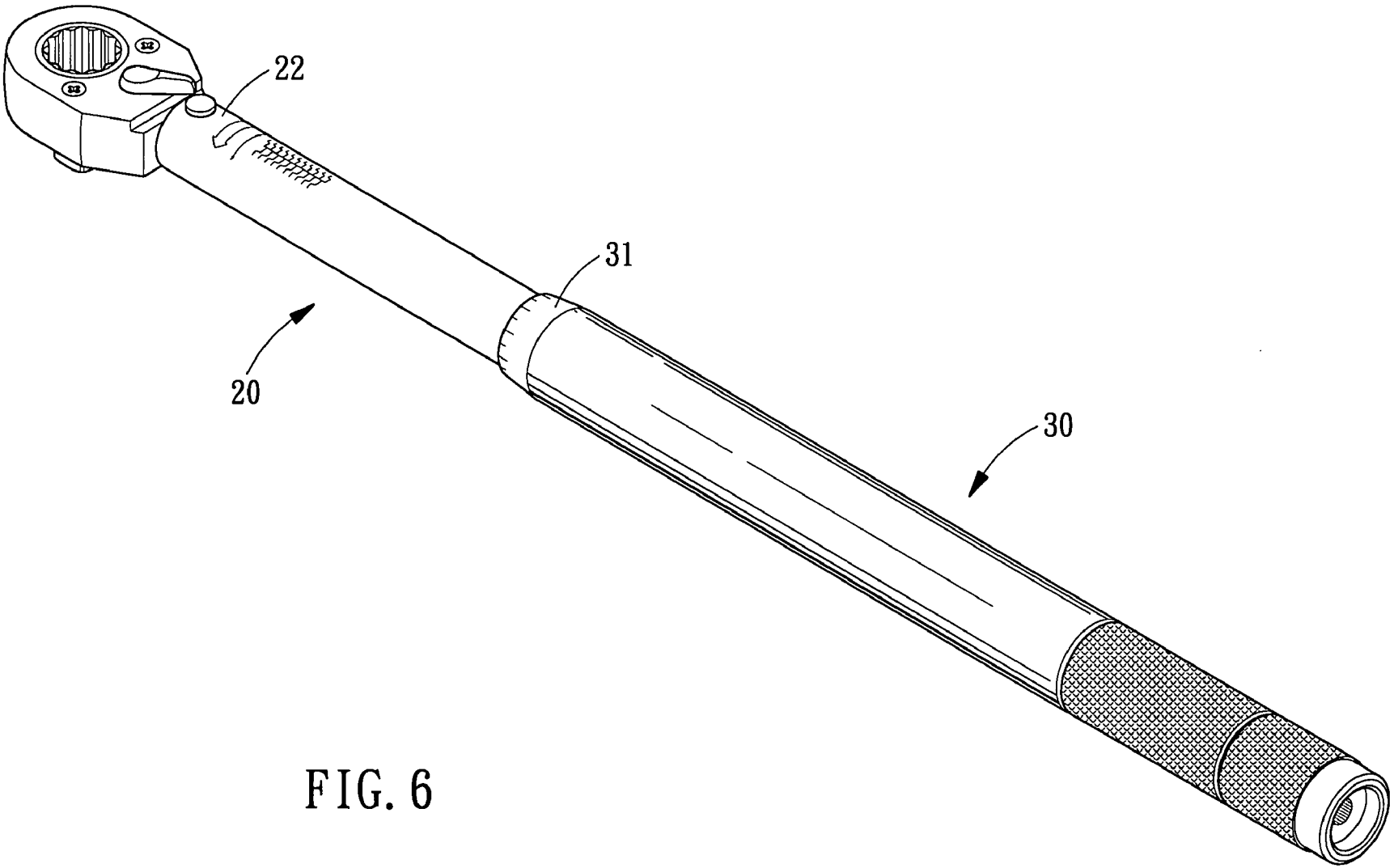
FIG. 6 is an operational view of a telescopic structure for a tool in accordance with a first embodiment of the present invention.
Figure 7:
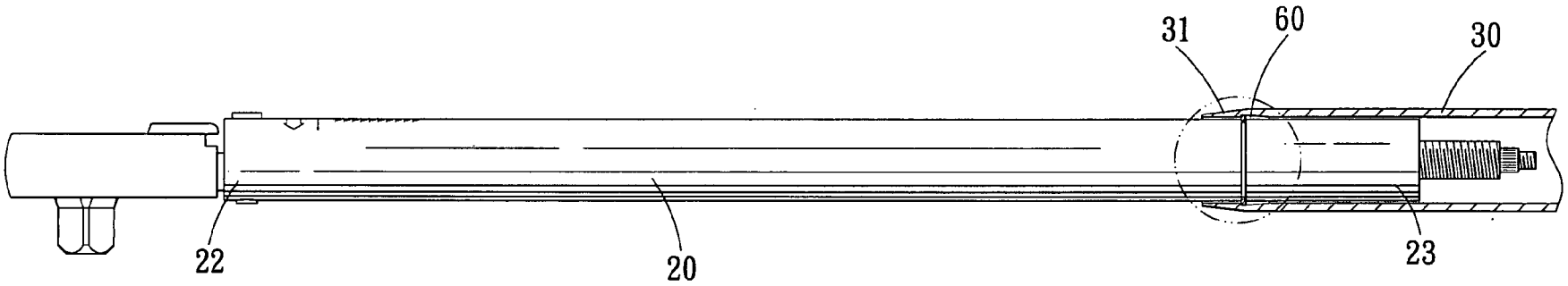
FIG. 7 is another operational view of a telescopic structure for a tool in accordance with a first embodiment of the present invention.
Figure 8:
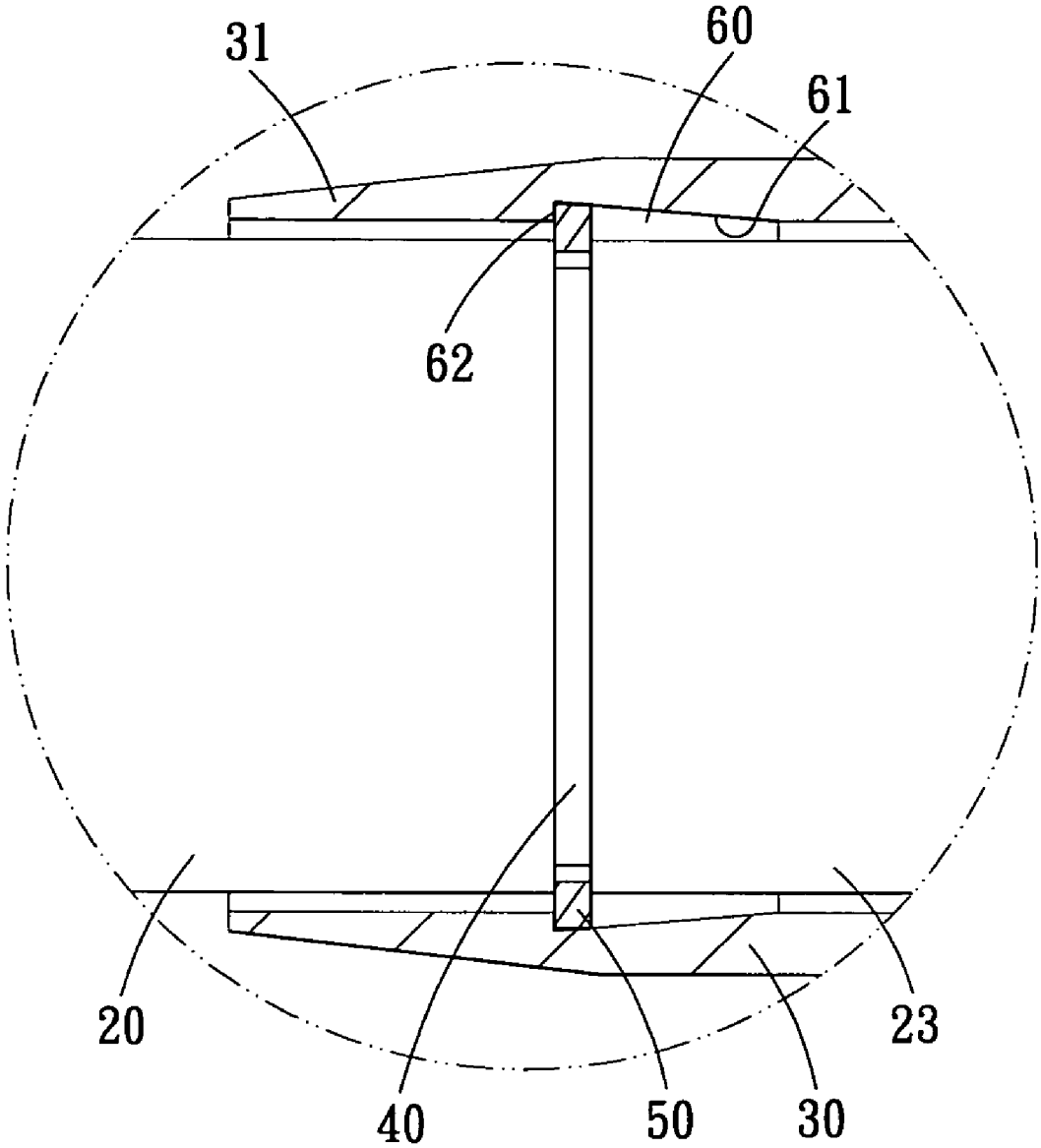
FIG. 8 is a partial amplified view of FIG. 7.

Referring to FIGS. 6–8, after torsion value of the torsion wrench is adjusted, the user can pull the handle 30 toward the connecting end 23 of the rod assembly 20. When the front end 31 of the handle 30 is approaching the connecting end 23 of the rod assembly 20, since the inner wall 34 close to the rear end 32 of the handle 30 is formed with the locking groove, the elastic ring 50 adjacent to the connecting end 23 of the rod assembly 20 will expand gradually as moving along the annular bevel surface 61 of the locking groove 60. The elastic ring 50 will finally abut against the annular vertical surface 62. Thus, the torsion wrench is lengthened. In other words, the distance between the handle portion and the work head of the torsion wrench is increased. Thereby, turning force applied on the handle of the tool for locking/unlocking a work piece can be saved.

It will be noted that the user can adjust the torsion force by pushing the handle 30 toward the drive end 22 of the rod assembly 20. Thus, the elastic ring 50 is compressed bit by bit when moving along the annular bevel surface 61 of the locking groove 60, and will disengage from the locking groove 60. Finally the drive portion 33 of the handle 30 is engaged with the threaded portion 211 of the central push rod 21. Thus, the torsion value can be adjusted.

In addition, if the tool in accordance with the present invention is a torsion wrench, it will have another function as mentioned bellow. When the handle 30 is pulled toward the connecting end 23 of the rod assembly 20, the drive portion 33 of the handle 30 will be disengaged from the threaded portion 211 of the central push rod 21. In this case, the preset torsion force won't be changed when the user is locking/unlocking a work piece by applying force on the handle 30. Thereby, the torsion force is accurate.

Figure 9:
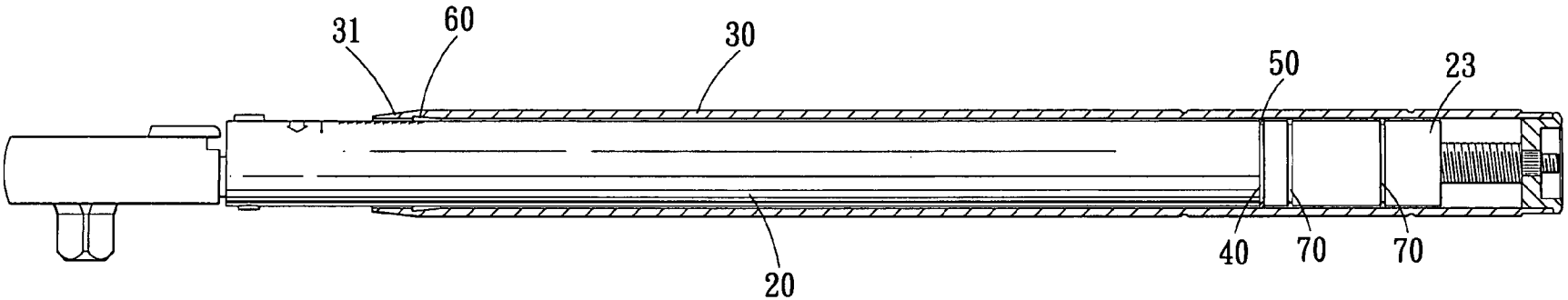
FIG. 9 is a cross sectional view of a telescopic structure for a tool in accordance with a second embodiment of the present invention.

Referring to FIG. 9, a telescopic structure for a tool in accordance with a second embodiment of the present invention is shown, the tool is a torsion wrench for example. The structure of the rod assembly 20 and the handle 30 are same as that of the first embodiment, so further explanations would be omitted. The telescopic structure also includes an annular positioning groove 40, an elastic ring 50 and a locking groove 60. The differences of the second embodiment as compared with the first embodiment are described bellow:

The rod assembly 20 is formed on the outer periphery with two backup annular grooves 70 which are located between the annular positioning groove 40 and the connecting end 23 of the rod assembly 20. The two backup annular grooves 70 are provided for receiving the elastics ring 50. When a pulling force applied on the handle 30 toward the connecting end 23 of the rod assembly 20 is over big and causes disengagement of the elastic ring 50 from the annular positioning groove 40, the backup annular grooves 70 can be provided for positioning the elastic ring 50 again. Thus, the handle 30 will not be completely disengaged from the rod assembly 20.

While we have shown and described various embodiments in accordance with the present invention, it should be clear to those skilled in the art that further embodiments may be made without departing from the scope of the present invention.

What is claimed is:

1. A telescopic structure for a tool comprising:

a hollow handle having formed on an inner wall thereof an annular locking groove at a front end of the handle, the handle having a drive portion at a rear end thereof;

a rod assembly having a connecting end being received in the handle and longitudinally displaceable therein, the rod assembly having an annular positioning groove formed on an outer periphery thereof; and an elastic ring received in the annular positioning groove of the rod assembly and biased against the inner wall of the handle, the elastic ring engaging the annular locking groove by displacement of the connecting end of the rod assembly away from the drive portion of the handle, whereby the displacement of the rod assembly is stopped.

2. The telescopic structure for a tool as claimed in claim 1, wherein the elastic ring has a rectangular cross section.

3. The telescopic structure for a tool as claimed in claim 1, wherein backup annular grooves are formed between the connecting end of the rod assembly and the annular positioning grooves.

4. The telescopic structure for a tool as claimed in claim 1, wherein the locking groove includes an annular bevel surface terminated by an annular vertical surface.

5. The telescopic structure for a tool as claimed in claim 1, wherein the connecting end of the rod assembly is selectively received by the drive portion of the handle by displacement of the connecting end of the rod assembly towards the drive portion of the handle.

* * * * *